US007300328B2

(12) United States Patent
Klick, Jr.

(10) Patent No.: US 7,300,328 B2
(45) Date of Patent: *Nov. 27, 2007

(54) MOUNTABLE INTERACTIVE TOY ANIMAL

(76) Inventor: Robert J. Klick, Jr., 2445 Orkla Dr., Golden Valley, MN (US) 55427

( * ) Notice: Subject to any disclaimer, the term of this patent is extended or adjusted under 35 U.S.C. 154(b) by 0 days.

This patent is subject to a terminal disclaimer.

(21) Appl. No.: 10/424,540

(22) Filed: Apr. 28, 2003

(65) Prior Publication Data

US 2004/0077273 A1 Apr. 22, 2004

Related U.S. Application Data

(60) Provisional application No. 60/375,696, filed on Apr. 26, 2002.

(51) Int. Cl.
*A63H 33/00* (2006.01)

(52) U.S. Cl. ..... 446/26; 446/28; 446/29

(58) Field of Classification Search ..... 446/268, 446/26, 28, 29, 297, 369, 370, 373, 374; 54/37.1, 38.1, 44.1, 44.2, 44.5, 84; 472/95, 472/133, 135; 297/181
See application file for complete search history.

(56) References Cited

U.S. PATENT DOCUMENTS

D159,705 S 8/1950 Whitney
2,526,786 A 10/1950 Whitney
2,534,904 A 12/1950 Feero
2,585,279 A 2/1952 Sickelbower
2,657,053 A * 10/1953 Conley ..... 297/181
2,659,600 A 11/1953 Becker
2,707,102 A 4/1955 Wendt
2,888,263 A 5/1959 Ruhmann et al.
2,896,948 A * 7/1959 Brodrib ..... 472/99
3,008,763 A * 11/1961 Lebow ..... 297/181
3,098,317 A * 7/1963 Guzman ..... 446/226
3,224,762 A 12/1965 Strader (Continued)

OTHER PUBLICATIONS

Small in the Saddle, Dakota 35 Plush Pony, Jul. 12, 2001, 1 page, website printout.

(Continued)

*Primary Examiner*—Monica Carter
*Assistant Examiner*—J Williams
(74) *Attorney, Agent, or Firm*—Patterson Thuente Skaar

(57) ABSTRACT

The present invention is directed to an interactive toy generally including a body having a body section and a head section. Generally, the body resembles an animal, such as a horse, or popular fictional characters. The body section includes a preformed engagement surface configured to secure to a wearer. The toy can also include an internal support structure helping to define the engagement surface as well as limiting movement of the head section. The body includes at least one securing member allowing a person to wrap a measurable portion of the securement member around their upper leg and/or knee. The level of securement is dependent upon the level of desired motion to be applied to the secured animal through motion of the person's leg. The interactive toy can also include an audio device for replaying recorded sounds such as animal sounds, voice recordings, nature sounds, and the like. Preferably, the sounds are manually initiated by a child by pulling, pushing, pressing, and the like, on a part or portion of the animal body.

6 Claims, 5 Drawing Sheets

U.S. PATENT DOCUMENTS

| | | | | | |
|---|---|---|---|---|---|
| 3,737,196 | A | * | 6/1973 | Bodor | 297/181 |
| 3,920,239 | A | | 11/1975 | White | |
| D250,967 | S | | 1/1979 | Effort | |
| D258,371 | S | | 2/1981 | Cox | |
| 4,249,338 | A | | 2/1981 | Wexler | |
| 4,333,642 | A | | 6/1982 | Adams | |
| D297,151 | S | | 8/1988 | Lewis | |
| 4,816,002 | A | * | 3/1989 | Brodrib | 446/373 |
| 4,875,732 | A | * | 10/1989 | Miller | 297/181 |
| 5,000,712 | A | | 3/1991 | Curry, Sr. | |
| D318,498 | S | | 7/1991 | Olson | |
| D321,217 | S | | 10/1991 | Utley | |
| 5,074,820 | A | * | 12/1991 | Nakayama | 446/29 |
| 5,205,775 | A | * | 4/1993 | Brodrib | 446/317 |
| 5,316,515 | A | | 5/1994 | Hyman et al. | |
| 5,679,049 | A | | 10/1997 | Arad et al. | |
| 5,762,531 | A | * | 6/1998 | Witkin | 446/374 |
| 5,975,982 | A | | 11/1999 | Spector | |
| 6,074,270 | A | * | 6/2000 | Wilcox et al. | 446/370 |
| 6,196,893 | B1 | | 3/2001 | Casola et al. | |
| 6,881,118 | B2 | * | 4/2005 | Klick, Jr. | 446/26 |

OTHER PUBLICATIONS

Small in the Saddle, Horse Pillow Pal, Jul. 12, 2001, 1 page, website printout.

Small in the Saddle, Pony Drag-A-Long, 1 page, website printout.

* cited by examiner

MOUNTABLE INTERACTIVE TOY ANIMAL

RELATED APPLICATIONS

The present application claims the benefit of U.S. Provisional Application No. 60/375,696 filed Apr. 26, 2002, and herein incorporated by reference in its entirety.

FIELD OF THE INVENTION

This invention relates to toy animals. More particularly, the present invention relates to an interactive toy animal securely mountable to the upper leg of a person and capable of safely receiving and holding a child.

BACKGROUND OF THE INVENTION

Conventional toy stuffed animals have long been a source of entertainment for children of all ages. However, the interaction between a child and the toy animal is primarily solitary in nature. Adult interaction and participation with the child seldom takes place with the child during this time. Instead, adults, and parents in particular, are generally forced to resort to other toys and recreational activities in order to obtain a more involved quality interaction with the child.

An example of one stuffed animal designed to promote such interaction is U.S. Pat. No. 5,000,712 to Curry, Sr., herein incorporated by reference in its entirety, disclosing a riding toy. While Curry, Sr. discloses a riding toy seeking to improve the interaction between an adult and a child, it lacks features that create a safe playing environment.

As a result, there is a need for a toy animal that is aesthetically and functionally designed to appeal to, and entertain, a child while at the same time permitting safe and secure interpersonal interaction between the child and an adult.

SUMMARY OF THE INVENTION

The present invention solves many of the interaction deficiencies with conventional animal toys. The present invention provides a toy animal that is mountable on the upper leg or knee of an adult such that a child may sit or ride on the animal. The motion of the animal is substantially facilitated by the generally horizontal and vertical motion of the adult's leg.

The present invention generally includes an animal body, a seating portion, and a plurality of securing straps. A myriad of animal bodies can be used, with one preferred embodiment being a small horse or pony. The animal body includes an internal support structure limiting movement of a head portion such that a child consistently has something to grasp or hold onto. In addition, the animal body has a preformed body portion designed to accommodate an adult's upper leg and/or knee. The preformed body portion includes a grasping surface to interface with the adult's knee and upper leg such that the body is positioned properly on the adult. The seating portion is designed to comfortably receive the child. The securing straps are of a length and functional design that enables a person to wrap a measurable portion of the strap around the upper leg and/or knee of the person to secure the animal. The level of securement is dependent upon the level of desired motion to be applied to the secured animal through motion of the person's leg. The interactive toy animal can also include various interactive sounds such as animal sounds, voice recordings, nature sounds, and the like.

The sounds are generally activated by pulling, pushing, pressing, and the like, on a part or portion of the animal body. Additionally, various body parts of the animal can be configured to move based on a triggering event.

DETAILED DESCRIPTION OF THE DRAWINGS

Figure 1:
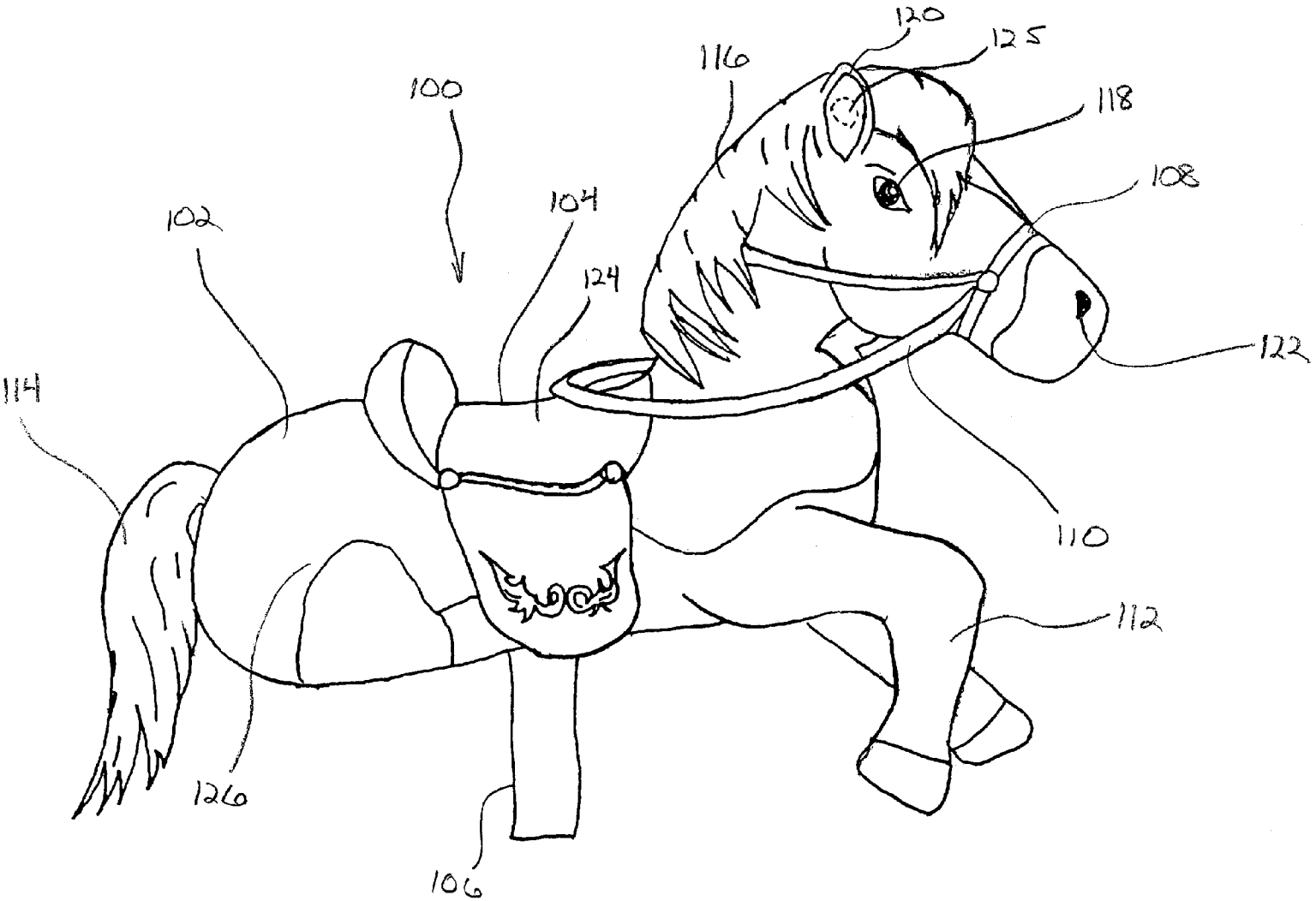
FIG. 1 is a side view of an embodiment of a stuffed animal of the present invention.

As depicted in FIG. 1, an interactive toy animal 100 of the present invention generally includes a body 102, a seating portion 104, and at least one securing strap 106. Preferably, seating portion 104 and the at least one securing strap 106 are stitched to body 102 though other appropriate attachment devices and means could be used as well. The securing strap 106 can be of varying lengths and materials depending on the functional and aesthetic requirements of the manufacturer and/or user. Securing strap 106 can be configured as a single securing member sufficiently long enough to wrap from one side of body 102, around a user's leg and to the other side of body 102. Alternatively, securing strap 106 can comprise a pair of securing members, one on each side of body 102 designed to attach underneath a user's leg. In one embodiment, securing strap 106 is designed to substantially wrap around the upper leg and/or knee. The securing strap 106 is then secured to prevent undesirable movement of the stuffed animal 100. The strap is preferably secured using Velcro®, though other fastener technologies such as hooks, buttons, snaps and other fastening technologies know to those skilled in the art could be utilized.

Preferably, body 102 has an exterior likeness resembling an animal or character that is visually appealing to young children. In one embodiment, body 102 resembles a horse including a harness 108, reins 110, legs 112, tail 114, mane 116, and facial features including eyes 118, ears 120 and nose 122. In such an embodiment, seating portion 104 takes the form of a saddle 124. Generally, body 102 and seating portion 104 are made of a plush exterior fabric 126. The appearance of fabric 126 can be altered from one embodiment to the next to provide visually appealing colors or to create differing horse breeds, for example, a palomino, a pinto or even a fictional character such as a unicorn. In addition to external features, body 102 can include a manual or automatic audio device 125 for providing realistic animal noises, such as galloping or neighing in the preferred embodiment, or other character, nature or recorded/recordable sounds. Audio device 125 can be selectively placed in or on the body 102. Examples of suitable locations include in or on the ear, in or on the reigns, in or on the tail and in or on the seat. Typically, audio device 125 incorporates a manual switch arrangement to activate playback of a prerecorded audio track stored on a microchip. Audio device 125 may take the form of other alternative configurations, for example those shown in U.S. Pat. Nos. 4,249,338; 5,679,049; 5,975,982 and 6,196,893, all of which are hereby incorporated by reference in their entirety. Audio device 125 will typically include an external visual indicator directing where a child should push, press or pull to activate playback of the prerecorded audio track. In other embodiments, audio device 125 may be activated simply by sitting on or moving the stuffed animal 100. In alternative embodiments, body 102 can include various pins, hinges, power-based driving mechanisms, and other known devices and techniques that facilitate movement of components such as legs 112, tail 114, mane 116, and the various facial features.

Figure 2:
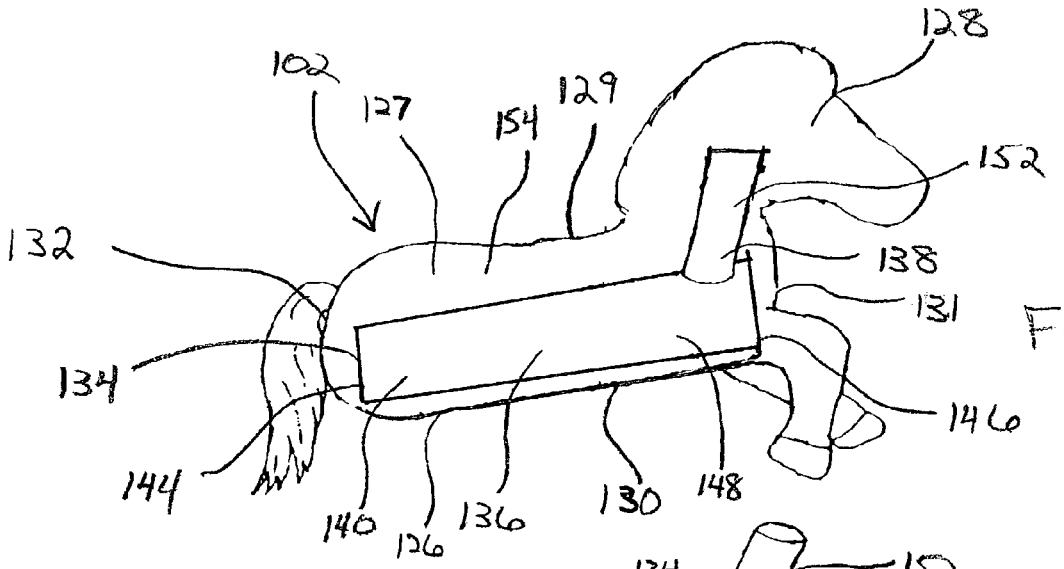
FIG. 2 is a sectional, side view of a body of the present invention.
Figure 3:
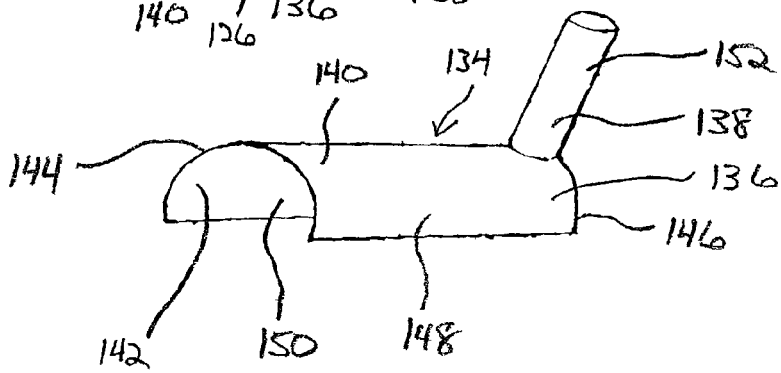
FIG. 3 is a perspective of an internal support structure of the present invention.
Figure 4:
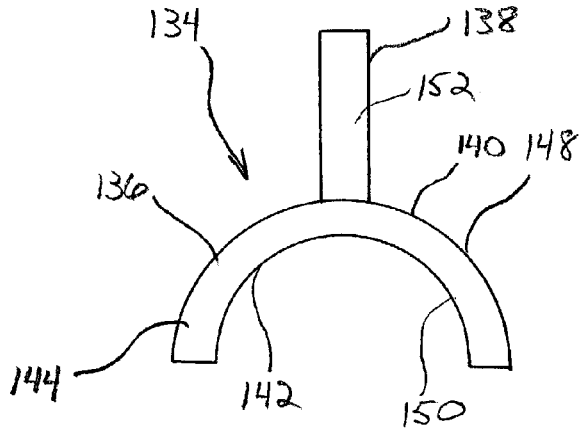
FIG. 4 is an end view of the internal support structure of FIG. 3.
Figure 5:
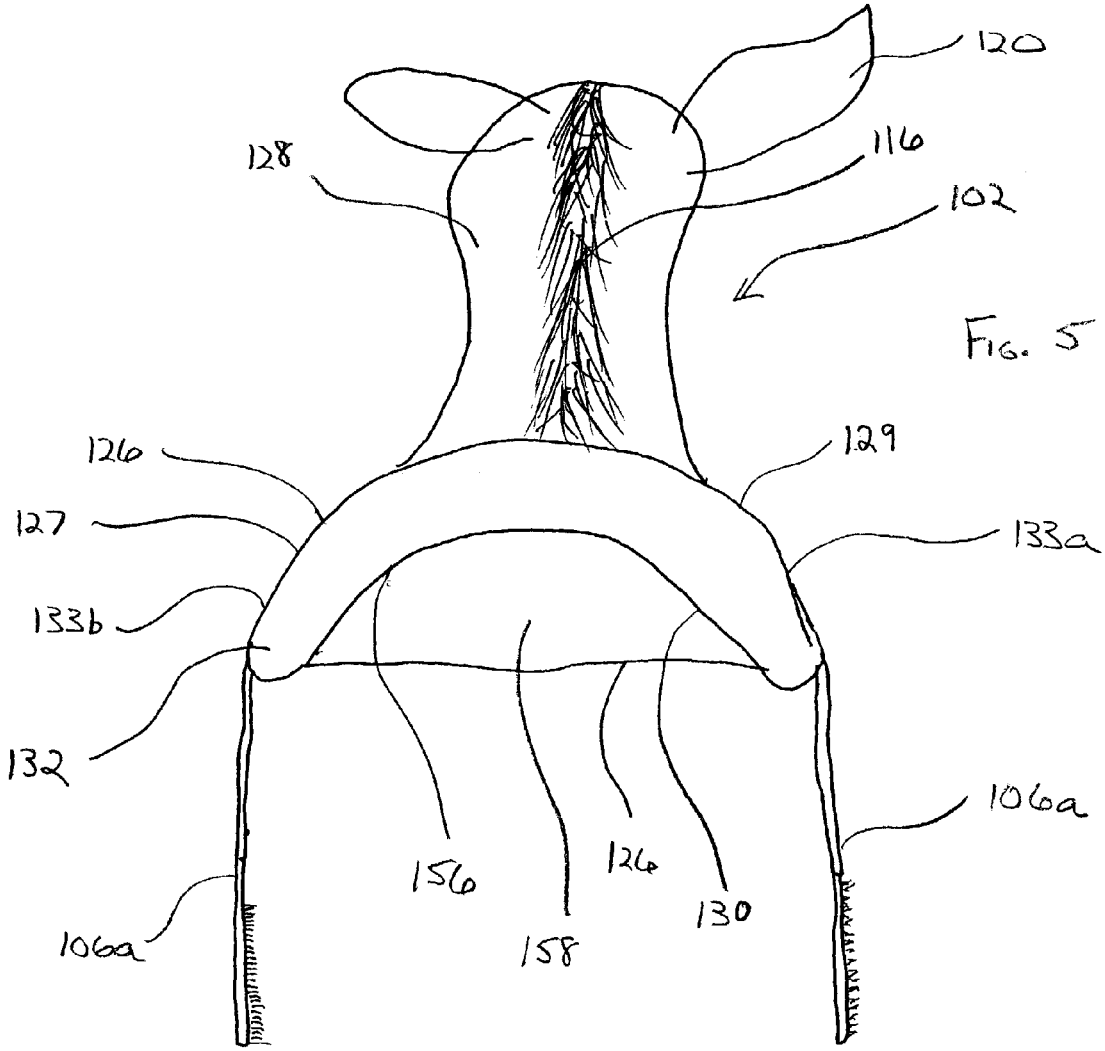
FIG. 5 is an end view of the body of the present invention.

Depicted in FIG. 2 is a sectional view of animal body 102. In a basic form, animal body 102 comprises a body section 127 and a head section 128. Body section 127 and head section 128 are generally formed by stitching fabric 126 into the desired shape and appearance. Body section 127 has a top portion 129, a bottom portion 130, a front end 131, a rear end 132 and a pair of visually similar sides 133*a*, 133*b*, as shown in FIG. 5. Within animal body 102 is an internal support structure 134, more clearly depicted in FIGS. 3 and 4, generally comprising a body support member 136 and a neck support member 138. Body support member 136 can comprise a length of relatively rigid material 140 formed to have a substantially half-circle cross-section 142. The relatively rigid material 140 can be constructed of cardboard, plastic and other similar materials. Cross-section 142 is generally consistent from a rear end 144 to a front end 146 of rigid material 140. Body support member 136 also includes a top surface 148 and a bottom surface 150. Depending on its length, securing strap 106 may be fixedly attached to body support member 136. Neck support member 138 can comprise a length of relatively rigid material 152 formed in a cylindrical or tubular orientation though other suitable shapes and designs are envisioned as well. In a preferred embodiment, body support member 136 and neck support member 138 are comprised of the same relatively rigid material. Generally, neck support member 138 is operably attached to the top surface 148 of body support member 136 proximate the front end 146. Attachment of neck support member 138 to body support member 136 can be accomplished with suitable attachment means such as adhesive, pressure fitting, fastening devices and other know methods such that neck support member 138 projects into or proximate head section 128. In constructing animal body 102, a padding material 154 is generally stuffed into body section 127 and head section 128 to give toy animal 100 a soft, cushiony feel while at the same time providing a protective layer over body support member 136. Bottom surface 150 can be covered by fabric 126 to make bottom portion 132.

As depicted in FIG. 5, the bottom portion 130 of animal body 102 defines a preformed engagement surface or portion 156 generally conforming to cross-section 142 of body support member 136. The engagement surface 156 is depicted as having an open end proximate the rear end 144 of body support member 136 while fabric 126 defines a closure or abutment surface or portion 158 positioned generally perpendicular or extending downward from the engagement surface 156 near the front end 146 of body support member 136.

Figure 6:
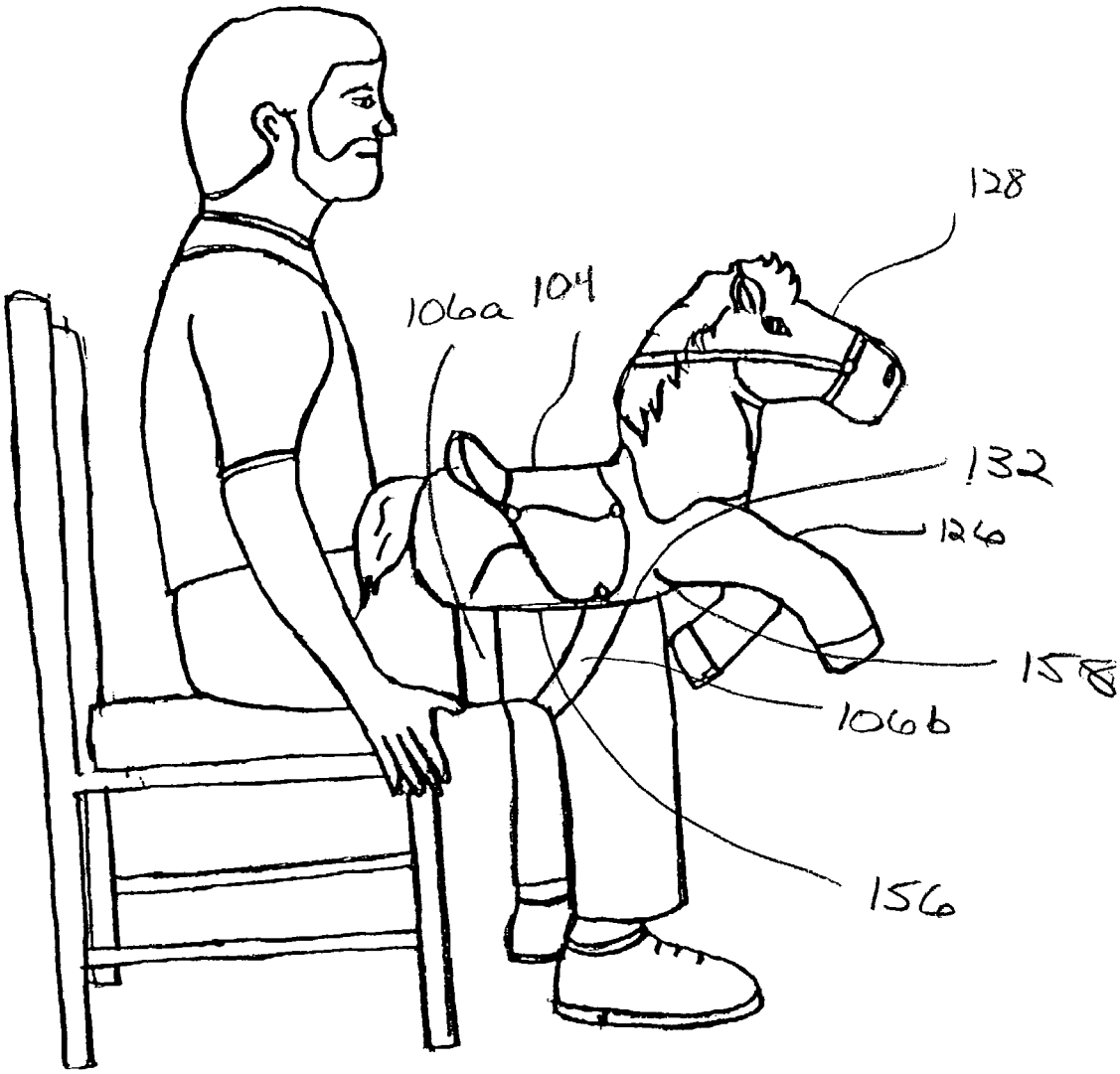
FIG. 6 is a side view of the stuffed animal of the present invention strapped to an adult's leg.
Figure 7:
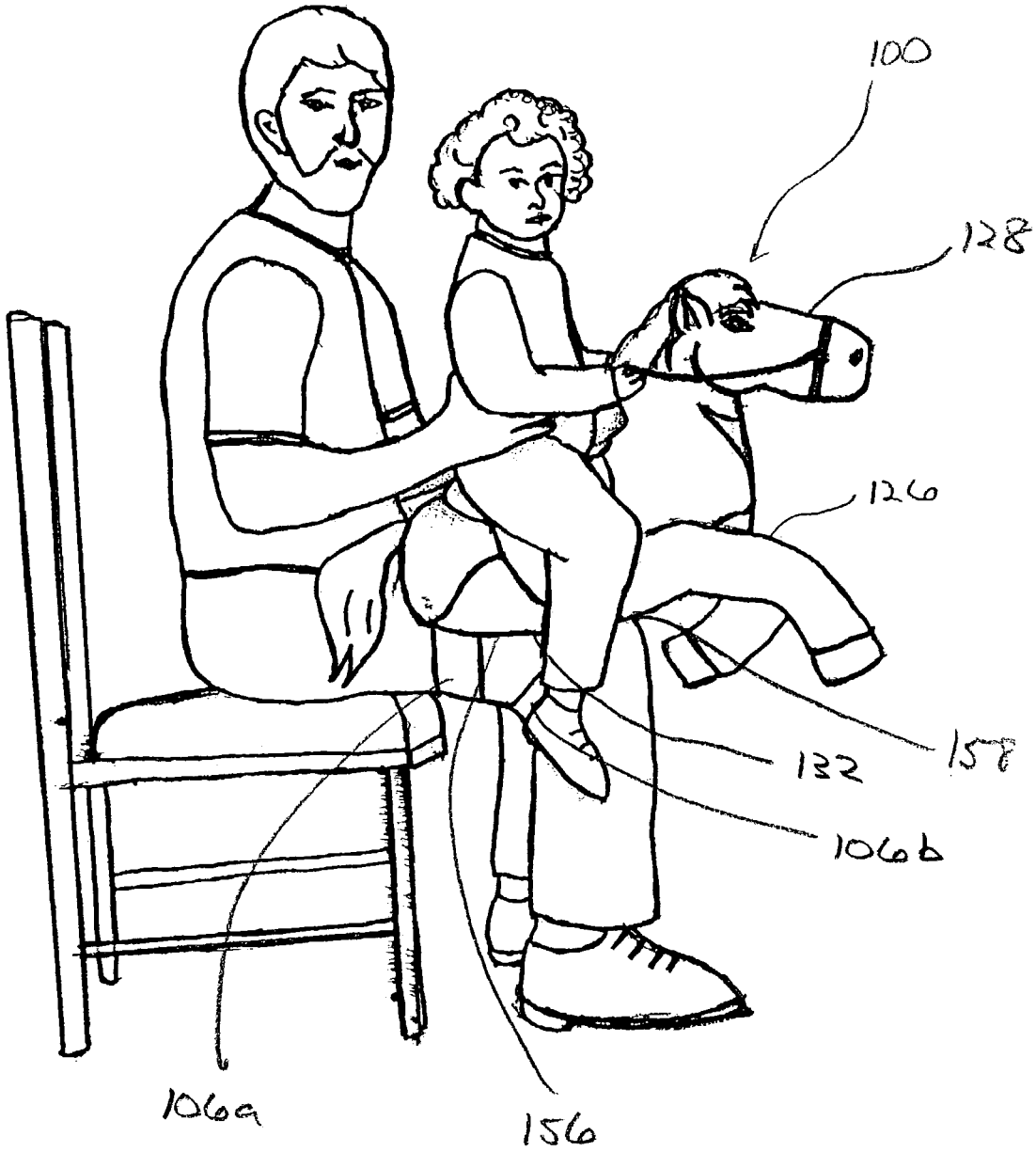
FIG. 7 is a side view of the stuffed animal of the present invention strapped to an adult's leg with a child seated on the stuffed animal.

Generally, the interactive toy animal 100 of the present invention is used as depicted in FIGS. 6 and 7. Generally, a seated adult or larger child orients the interactive toy animal 100 such that head section 128 is facing away from the adult. The adult places the preformed engagement surface 156 over the top of his or her leg. The adult slides the stuffed animal 100 toward him or her such that the closure surface 158 comes into abuttable contact with the adult's knee. The perpendicular orientation of closure surface 158 to engagement surface 156 prevents stuffed animal 100 from sliding closer to the adult. Once the stuffed animal 100 is properly positioned, a pair of securing straps 106*a*, 106*b* are securely wrapped around the leg and fastened. The combination of the preformed engagement surface 156, closure surface 158 and securing straps 106*a*, 106*b* insure a tight, secure fit between the bottom portion 131 and the adults leg resulting in increased safety to small children seated on stuffed animal 100. If securing straps 106*a*, 106*b* have been attached to body support member 136, securely wrapping the securing straps 106*a*, 106*b* leads to a further constriction of preformed engagement surface 156 around the leg. The presence of closure surface 158 prevents toy animal 100 from being placed backwards on an adult's leg and increases the degree of shroudable securement of the engagement surface 156 around the leg. The shrouding effect of the shape and design of the engagement surface 156 stabilizes the toy animal 100 during lateral movements as well. The combination of engagement surface 156 and closure surface 158 eliminate the possibility that a child could tumble backwards from toy animal 100 as the adult's body is always located at the rear of toy animal 100. It will be obvious to one skilled in the art that body 102 could also be constructed such that closure surface 158 is proximate rear end 144 allowing front end 146 to be open. Such an alternative design would permit the reversal of toy animal 100 on an adult's leg such that the head section 128 faces toward the adult. Regardless, the closure surface 158 is positioned accordingly to increase safety through improved security of the toy animal 100 to the adult's leg.

Once a child is seated on seating portion 104, the adult begins to move his or her leg in a preferably up and down direction to simulate the type of movement one might experience when riding a horse or similar animal. As this movement may be quick and sudden, it is necessary to provide the child with something they can grasp onto such that they can remain within the seating portion 104. The internal support structure 134, especially neck support member 138, prevents the child from falling from the toy animal 100 by limiting movement of the head section 128. Through the use of a relatively rigid material in the construction of the body support member 136 and the neck support member 138, forward, backward and lateral movements of the head section 128 are limited such that the child can consistently grasp, hold or lien on the head section 128 without fear of falling forward or to the sides due to sudden movement of the head section 128.

The present invention may be embodied in other specific forms without departing from the spirit of the essential attributes thereof; therefore, the illustrated embodiments should be considered in all respects as illustrative and not restrictive.

The invention claimed is:

1. An interactive toy comprising:

a body generally resembling an animal, the body including a body section and a head section, the body further including a generally rigid internal support structure encased within the body, the generally rigid internal support structure having an integral body support and neck support, the body support having a generally arcuate cross-section defining a preformed leg engagement surface on a bottom portion of the body section, the neck support extending into and further adapted to substantially limit movement of the head section;

a seating portion located on a top portion of the body section; and at least one adjustably securable attachment member fixedly attached to the body section, the attachment member adapted to attach to both sides of the body section.

2. The interactive toy of claim 1 wherein the body section further comprises an abutment surface extending downward generally traverse from the preformed leg engagement surface for limiting slidable movement of the body section.

3. The interactive toy of claim 1 wherein the body resembles a horse.

4. The interactive toy of claim 1 wherein the body further comprises a layer of padding within the body section and the head section.

5. The interactive toy of claim 1 wherein the body further comprises an audio device including a prerecorded soundtrack and a switch for initiating playback of the soundtrack.

6. The interactive toy of claim 1 wherein the generally rigid internal support structure comprises cardboard.

* * * * *